US005100004A

United States Patent [19]

Kuchenbecker

[11] Patent Number: 5,100,004

[45] Date of Patent: Mar. 31, 1992

[54] CARTON HAVING A BARRIER CONSTRUCTION AND METHOD OF MAKING THE SAME

[75] Inventor: Morris W. Kuchenbecker, Neenah, Wis.

[73] Assignee: James River Corporation of Virginia, Richmond, Va.

[21] Appl. No.: 636,124

[22] Filed: Dec. 31, 1990

[51] Int. Cl.[5] ..... B05D 5/70

[52] U.S. Cl. ..... 229/238; 229/137; 229/244

[58] Field of Search ..... 206/621, 625, 628, 621, 206/625, 628; 229/137

[56] References Cited

U.S. PATENT DOCUMENTS

| | | | |
|---|---|---|---|
| 3,167,238 | 1/1965 | Smith | 206/625 |
| 3,399,820 | 9/1968 | Foster et al. . | |
| 3,580,466 | 1/1969 | Thelen et al. . | |
| 3,667,923 | 11/1962 | Thiets | 229/137 |
| 4,043,503 | 8/1977 | Meyers et al. | 206/625 |
| 4,093,115 | 6/1978 | Bachner et al. | 206/621.3 |
| 4,285,461 | 8/1981 | Meyers | 206/621 |
| 4,613,046 | 9/1986 | Kuchenbecker . | |
| 4,687,104 | 8/1987 | Ielmini . | |
| 4,746,019 | 5/1988 | Prater . | |
| 4,951,824 | 8/1990 | Kuchenbecker et al. . | |

*Primary Examiner*—Stephen Marcus
*Assistant Examiner*—Christopher McDonald
*Attorney, Agent, or Firm*—Sixbey, Friedman, Leedom & Ferguson

[57] ABSTRACT

A paperboard carton blank including a first panel having side walls connected thereto by scored fold lines formed between a respective one of the side walls and a respective edge of the first panel is disclosed. A second panel is provided having a side wall connected thereto by a scored fold line formed between the side wall and an edge of the second panel. A seal flap is provided and extends a predetermined distance from a predetermined edge of one of the side walls of the first panel, the predetermined edge of the side wall being that edge which extends adjacent to a predetermined edge of the second panel of a carton formed from the blank. The blank also includes opposing end panels connected to each of the side walls and the first and second panels with each of the end walls having a die cut edge. A predetermined region of each of the end panels is skived adjacent to the die cut edge in order to reduce the resultant thickness of the end panels when sealed and a cover flap is provided to overlie the end panels of the sealed carton. An opening feature defined by the predetermined edge of the second panel and regions of weakness formed in the second panel extending from the predetermined edge of the second panel for permitting access to the inside of a carton formed from the blank is also provided with the regions of weakness being formed of a pair of substantially parallel lines of weakness with at least one of lines of weakness being a knurled line of weakness. The above paperboard blank being used to form a carton of a high barrier carton construction for containing a product placed therein wherein no die cut edges are exposed within the interior of the carton and the resultant carton exhibits a smooth continuous end cover.

20 Claims, 6 Drawing Sheets

CARTON HAVING A BARRIER CONSTRUCTION AND METHOD OF MAKING THE SAME

BACKGROUND OF THE INVENTION

1. Technical Field

The present invention relates to a carton having a barrier construction and a method of making the same which is to be filled with a consumable product accessible through an opening in the carton. More particularly, the invention pertains to a carton which when sealed forms a resistant barrier between the contents thereof and the surrounding environment.

2. Background Art

Paperboard cartons have been manufactured with a variety of constructions and opening features which allow the consumer access to the contents of the carton. Many of these constructions, however, are not concerned with the effects of the environment on the consumable product contained within the final carton. Additionally, the opening features which may consist of perforations, herringbone cuts, adhesive weaknesses, as well as other means of providing a point along the top panel, side panel or hinge lines where the carton may be most readily opened or similarly unconcerned about the detrimental affects of the environment on the contents of the carton.

U.S Pat. No. 3,399,820 issued to Foster et al. discloses one such opening feature commonly employed in cartons of this type. This opening feature is what is known as a double cut score opening feature which is formed by way of double cut scores; i.e., a pair of inner and outer cuts in the paperboard material with the cuts of each pair running parallel to one another, along a panel of the carton. By so providing these cut score lines, when the consumer applies an upward force or opening force on the tear flap provided between the pairs of cut score lines, ply separation occurs in the region between the inner and outer cut score lines. Continued pulling of the tear causes complete separation of the opening flap to allow the consumer unobstructed assess to the contents of the carton.

Similar opening features are disclosed in U.S. Pat. No. 4,746,109 issued to Krater and U.S. Pat. No. 4,613,046 issued to Kuchenbecker. As in the abovementioned patent, a point of weakness is provided in a panel of a respective carton where ply separation of the panel is permitted to occur when the consumer applies an opening force to the pull tab. The ply separation occurs between two pairs of reverse cut lines which are formed at least halfway through the panel of the carton area. However, when forming the paperboard blanks which are to be later used and erecting the cartons disclosed, both sides of the paperboard material are cut approximately 50% of the paperboard thickness into the carton. By cutting through both sides of the paperboard carton, the barrier which may have previously existed due to various coatings provided on the paperboard is reduced. By cutting into both sides of the paperboard, there is left only the plies of the paperboard material which are impervious to moisture and subsequently cannot prevent the leaking of moisture into and out of the carton. Moreover, the construction of the abovementioned cartons results in the exposure of bare edges of paperboard material within the internal cavity of the erected carton. Presenting such exposed paperboard edges within the cavity of the formed carton will allow wicking to occur as with the double cut score feature which in time could result in contamination of the contents of the container or leakage of the contents from within the container.

U.S. Pat. No. 4,687,104 issued to Ielmini discloses a similar carton construction having double cut scores formed on the inner and outer surfaces of the top and front flaps thereof. Again, as with the previous constructions, by partially cutting through both sides of the paperboard carton, the barrier which may have previously existed due to the various coatings provided on the paperboard material would be eliminated, thereby resulting in possible contamination of the contents of the carton or leakage of such contents. Additionally, as with the previously mentioned constructions, bare edges of the paperboard material will be exposed within the cavity of the formed carton thereby resulting in the possible contamination or leakage of the contents of the carton.

In an attempt to overcome the shortcomings associated with the above-described carton construction, cartons of the form known in the art has bag-in-a-box type constructions where developed. One such carton is illustrated in U.S. Pat. No. 3,580,466 issued to Thelen et al. wherein a bag formed of a plastic or treated paper material is positioned within the carton prior to its final sealing procedures. The carton may be formed having the double cut score opening feature; however, because the contents are enclosed within the plastic bag within the carton, the contents thereof are not exposed to any environmental affects nor is it possible for the contents of the bag to leak from the carton. However, such construction adds significantly to the cost of the carton, as well as the manufacturing process entailed in forming the final product.

U.S. Pat. No. 4,951,824 issued to Kuchenbecker et al. discloses one solution to the aforementioned problem of leaking in the top panel of the formed carton at the region of weakness necessary for forming the opening feature. Therein, the inner line of weakness is formed by way of a crease score line rather than a partially cut score line such that the integrity of the inner surface of the top panel is maintained. However, the overall construction of the carton when erected results in the exposure of bare edges of the carton blank within the inner cavity of the carton. Again, as mentioned above, this may result in the contamination of the contents of the carton or leakage of the contents therefrom.

Therefore, as can be seen from the foregoing, there is clearly a pressing need for a carton of the above-mentioned type which will provide a reliable opening feature that is capable of opening with ease by the consumer, which will resist the infiltration of moisture and will not retard the structural integrity of the carton when opened. Moreover, there is a pressing need for a carton having a construction which does not result in the exposure of bear paperboard edges within the inner cavity of the carton, thus eliminating any potential of leakage of the contents or contamination thereof.

SUMMARY OF THE INVENTION

It is a primary object of the present invention to overcome the aforementioned shortcomings associated with the prior art.

Another object of the present invention is to provide a paperboard carton of a high barrier construction which includes a reliable opening feature which is capable of being easily and reliably opened by the consumer without destroying the structural integrity of the carton.

Yet another object of the present invention is to provide a paperboard blank for forming a carton of a high barrier construction for forming a moisture barrier between the contents of the carton and the surrounding environment.

It is yet another object of the present invention to provide a carton of a construction wherein no bare die cut edges are present in the interior of the carton by skiving and hemming or overfolding any die cut edges which would normally be exposed within the interior of the carton.

These as well as additional objects and advantages of the present invention are achieved by producing a paperboard carton blank including a first panel having side walls connected thereto by scored fold lines formed between a respective one of the side walls and a respective edge of the first panel. A second panel is provided having a side wall connected thereto by a scored fold line formed between the side wall and an edge of the second panel, with one of the side walls of the first panel and the side wall of the second panel being congruent. A seal flap is provided and extends a predetermined distance from a predetermined edge of one of the side walls of the first panel, the predetermined edge of the side wall being that edge which extends adjacent to a predetermined edge of the second panel of a carton formed from the blank. The blank also includes opposing end panels connected to each of the side walls and the first and second panels with each of the end walls having a die cut edge. A predetermined region of each of the end panels is skived adjacent to the die cut edge in order to reduce the resultant thickness of the end panels when sealed and a cover flap is provided to overlie the end panels of the sealed carton. The blank also includes an opening feature defined by the predetermined edge of the second panel and regions of weakness formed in the second panel extending from the predetermined edge of the second panel for permitting access to the inside of a carton formed from the blank. The regions of weakness being formed of a pair of substantially parallel lines of weakness with at least one of the lines of weakness being a knurled line of weakness.

The above paperboard blank being use to form a carton of a high barrier construction for containing a product placed therein. The carton comprises a bottom panel, a top panel, side walls extending from the bottom panel to the top panel and overlapping end walls extending from the bottom panel to the top panel with each end wall having a die cut edge. A seal flap extends a predetermined distance from a predetermined edge of one of the side walls, with the predetermined edge of the side wall being that edge which extends adjacent to a predetermined edge of the top panel. An opening feature is also provided in the top panel which is defined by the predetermined edge of the top panel and regions of weakness formed in the top panel which extend from the predetermined edge of the top panel for permitting access to the interior of the carton. In order to provide a high barrier construction, a predetermined region of each of the end walls is skived adjacent to the die cut edge in order to reduce the resultant thickness of the end panels when sealed and a cover flap is provided to overlie the end panels of the sealed carton.

The regions of weakness are formed in the carton by first forming a first line of weakness in a first surface of the paperboard blank, then forming a second line of weakness in an opposing surface of the paperboard blank substantially parallel to and offset from the first line of weakness thus defining the region of weakness therebetween with at least one of the lines of weakness being a knurled line of weakness.

These as well as additional advantages of the present invention will become apparent from the following detailed description of the invention with reference to the several figures.

DETAILED DESCRIPTION OF THE PREFERRED EMBODIMENT

Figure 1:
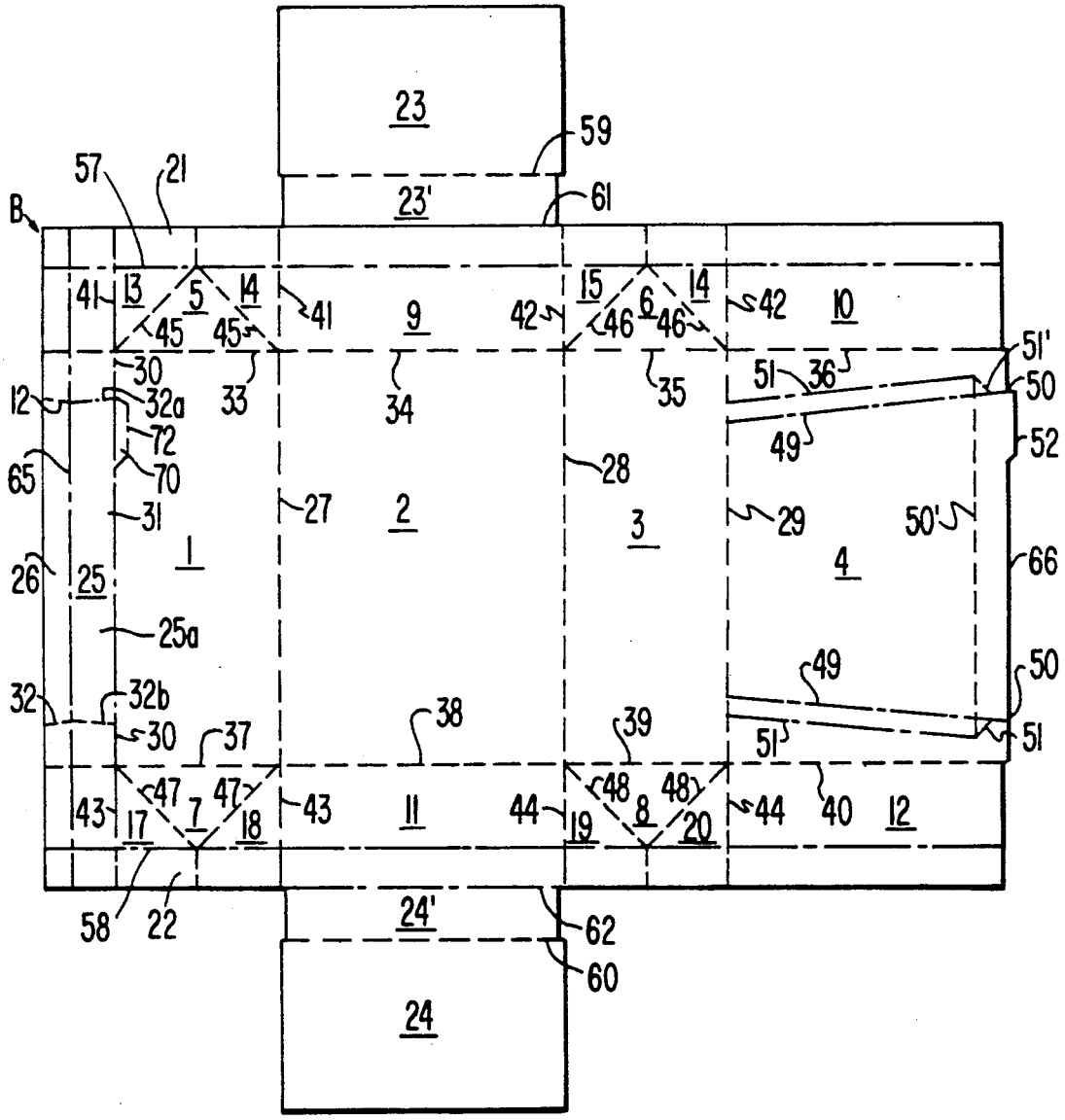
FIG. 1 is a plan view of the carton blank used in forming the carton in accordance with the preferred embodiment of the present invention.

Referring now to FIG. 1, the paperboard carton blank B is illustrated and includes a front panel 1, a first or bottom panel 2, back panel 3 and a second or top panel 4. The front and back panels 1 and 3 are flanked by end panels 5 and 7, and 6 and 8, respectively. The bottom and top panels 2 and 4 are flanked by end panels 9 and 11, and 10 and 12, respectively. The end panels 5, 6, 7 and 8 each include diagonal web panels 13, 14, 15, 16, 17, 18, 19 and 20 formed therein. Attached to the end panels are extensions 21 and 22, which extend the entire length of the blank B. Attached to front panel 1 is a side seam 25 and attached to the side seam is an extension 26, the significance thereof will be set forth in greater detail hereinbelow. The paperboard material is preferably overcoated with polyethylene or other similar barrier materials. These materials may also be chosen to be suitable in a microwave oven. Those skilled in the art will certainly appreciate that the specific coating selected will be directly dependent upon the intended use of the resulting carton. The blank B may further include a metallic coating.

The carton blank B additionally has main body crease score lines 27 between the front panel 1 and bottom panel 2, 28 between bottom panel 2 and back panel 3, and 29 between back panel 3 and top panel 4. The front panel 1 further includes crease scores 30 and outside partial cut score 31 which is cut to a depth of 50% of the paperboard thickness forming the hinged joint between the front panel 1 and the side seam 25. The extension 26, which is an extension of the heat seal side seam 25, further includes through knife cuts 32. Partial cut scores **32*a* and 32*b* are provided as continuations of the through knife cuts 32 and extend from the extension 26 to the partial cut score 31. In doing so, a release area 25*a* is formed in the side seam 25**. The significance of such release area will be described in greater detail herein below.

The front, bottom, back and top panels are divided from the end panels by crease score lines 33–40 as illustrated. End panels 5, 6, 7 and 8 include web folding crease score lines 41–44 are an extension of crease score lines 27, 28, 29 and 30. Also diagonal web crease score lines 45, 46, 47 and 48 are provided.

The top panel 4 includes an opening feature formed of crease score lines or partial cut score lines 49 and outside partial cut score lines 51. These crease score lines and partial cut score lines combine to form the opening feature for gaining access to the contents of the carton of the present invention. Such an opening feature is as set forth in U.S. Pat. No. 4,951,824 issued to Kuchenbecker and assigned to the assignee of the present invention the content of which is hereby incorporated herein by reference. The opening feature includes a lift tab 52 which is preferred over the outside tear flap of U.S. Pat. No. 4,951,824 for the reasons discussed in copending application Ser. No. 616,357 filed Nov. 12, 1990, the content of which is hereby incorporated herein by reference. Lead-in through cuts 50 which are cut through the entire thickness of the paperboard material are further provided to aid in the initiation of the ply separation. These through cuts 50 extend substantially colinear with the lines 49. The lines of weakness 51 extend substantially parallel to the lines of weakness 49 and include a convergent portion 51' which extends at an angle from the lines of weakness 51 toward the lines of weakness 49 and intersects the lines of weakness 49 at the termination of the lead-in through cuts 50. A further crease score fold line 50' may be provided to extend between the regions of weakness formed by the respective pairs of lines of weakness 49, 51 for facilitating reclosure of the carton. This being set forth in greater detail in the abovementioned copending application. As an alternative to the foregoing opening feature, a knurled line of weakness may also be formed in the top panel 4. This particular opening feature is described in greater detail in Copending Application Ser. No. 636,123 filed on Dec. 31, 1990, the contents of which are hereby incorporated herein by reference.

After the carton blank is die cut, it is necessary to skive certain areas of the blank to eliminate the presence of any raw edges which would exist in the inside of the carton which would allow the transfer of moisture or other liquids or gases between the carton contents and the environment and to facilitate the sealing of the end panels. The extensions 21 and 22 of the end panels 5, 6, 7 and 8 are skived on the outside to a width that terminates at lines 57 and 58. Skiving is carried out in a manner similar to that of routing wood when wood-working. Herein, a cutting blade removes a predetermined thickness of the paperboard material at this predetermined area. The depth of the skive can vary, however, it has been found that when using a paperboard material having a caliper or thickness of 0.014 inches, a skive having a depth of 0.007 or approximately one half of the paperboard thickness is preferred in order to form a smooth end seal. The significance of such is set forth in greater detail with reference to FIGS. 5 and 6. The extension panel 26 of side seam 25 is also skived on the outside thereof, receives an application of adhesive and is folded along crease score line 65 such that it will be bonded to the outside of side seam 25.

In addition to the skived extensions 21 and 22, extensions or cover flaps 23 and 24 are also provided. These cover flaps 23 and 24 are connected to the skived extensions 21 and 22 by intermediate sections 23' and 24', respectively. Crease score fold lines 59 and 60 are provided for to permit the cover flaps 23 and 24 to pivot with respect to the intermediate sections 23' and 24'. Additionally, the intermediate sections 23' and 24' will be capable of pivoting along lines 61 and 62, respectively, due to the skiving of extensions 21 and 22 which significantly reduces the thickness of the paperboard material in this area and thus effectively forms a fold line.

Figure 6:
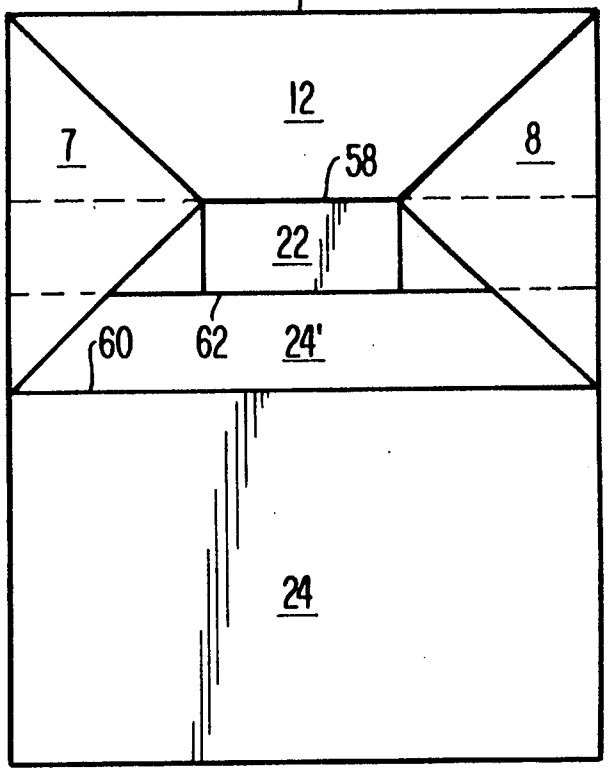
FIG. 6 is an end view of a partially erected carton showing underlying end panels and an overlapping skived area after sealing.
Figure 5:
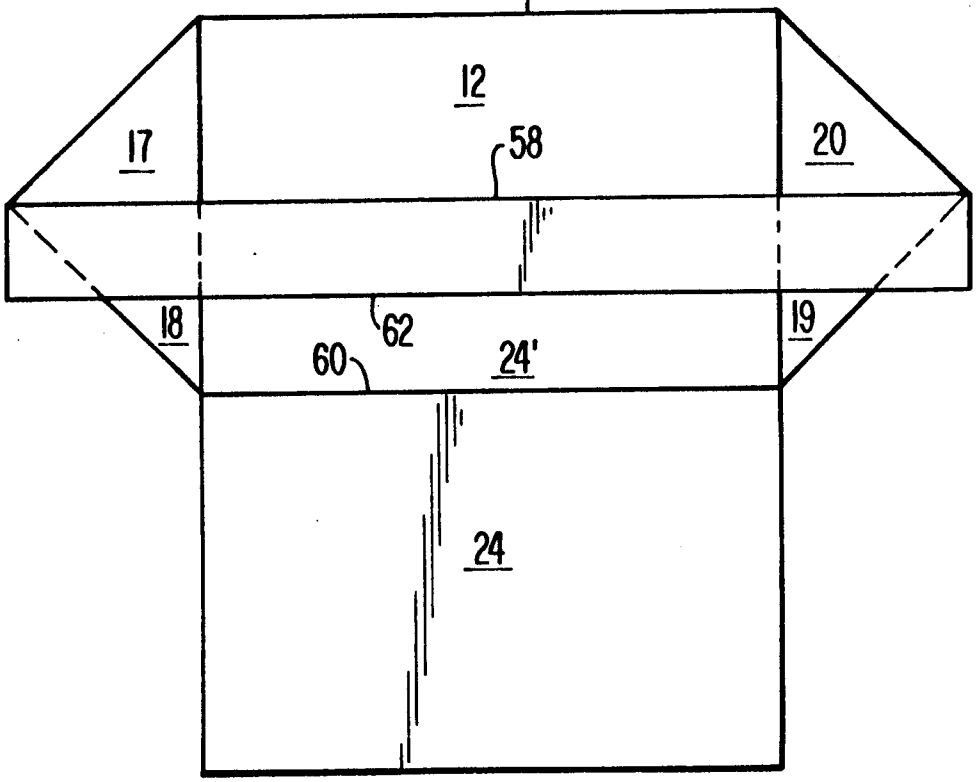
FIG. 5 is an end view of a partially erected carton showing underlying end panels and an overlapping skived area after sealing.

Referring now to FIGS. 5 and 6, the folding of the end panels will now be set forth in greater detail. Once the paperboard blank B has been overfolded and side seamed along the seal flap 25, the end panels are folded in order to close the now formed tubular structure. It should be noted that the cooperating end panels on each side of the tubular member may be closed and sealed after the insertion of the contents into the tubular member or one side may be closed and sealed prior to the insertion of contents with the other being closed and sealed after the insertion of the contents into the tubular member. The configuration of the end panels set forth in FIG. 5 is achieved by folding end panels 11 and 12, 90 degrees about the fold lines 38 and 40, respectively, while pivoting the end panels 7 and 8 outwardly 90 degrees such that the end panels 7, 8, 11 and 12 by essentially in the same plane. In doing so, the web panels 17, 18, 19 and 20 will be overfolded on top of the respective end panels 7 and 8 as illustrated. From the view shown in FIG. 5, the end panels 7 and 8 underlie their respective web panels 17, 18, 19 and 20. The now overlapping sections of the extension 22 is positioned such that the inner portions (the side of the extension which has not been skived) are positioned in contact with one another. The extension 22 is initially extended 90 degrees with respect to each of the end panels 11 and 12 and, subsequently, overfolded onto the end panel 11. The intermediate section 24' also will overlie the end panel 11. As can be noted, the dimension of the extension 22 and the intermediate section 24' is essentially equal to that of end panel 11 such that when the end panels are positioned as shown in FIG. 5, the crease score fold line 40 corresponds to and overlies the crease score line 38. Once in the position as shown in FIG. 5, the end panels are heat sealed such that the skived portions adhere to one another and the intermediate section 24' adheres to the end panel 11. Preferably, such sealing is carried out by heat sealing the overcoated panels to one another; however, any conventional sealing method used for the sealing of paperboard cartons may be employed.

Referring now to FIG. 6, once the end panels have been sealed as indicated in FIG. 5, the end panels 7 and 8 are overfolded 180 degrees onto the end panel 12 extension 22 and intermediate section 24'. Once in this position, the end panels 7 and 8 may be secured to the end panel 12 and intermediate section 24'; however, such is not necessary. Once the end panels 7 and 8 have been overfolded onto the end panel 12 and intermediate section 24', the cover flap 24 is pivoted 180 degrees about crease score fold line 60 to cover each of end panels 7, 8 and 12 and the intermediate section 24', this positioning being illustrated in FIGS. 2–4. Once in this position, the cover flap 24 is heat sealed over the underlying end panels, thereby resulting in a clean and smooth end panel surface. It should be noted that the opposing end of the tubular structure is folded and sealed in a manner identical to that discussed above. Furthermore, it should be noted that because of the smooth nature of the end panel construction, the cover flap 24 may include printed matter which may be readily viewed by the consumer.

Because the extensions 21 and 22 are skived, the resultant end panel structure will not include a thick central seam due to the removal of the paperboard material in this are and, consequently, a smooth outer surface will result. If the extensions 21 and 22 were not skived as previously mentioned, the end panel construction would include a raised central section and, thus, interfere with the proper sealing of the cover flaps 23 and 24 and, moreover, will result in an esthetically unpleasing final carton construction.

Returning now to FIGS. 2–4, it has been found that a full-length lift tab between crease score opening feature lines 49 and 50 and the cut score release area 25 extending from front panel 1 offers resistance to opening when a front-to-rear direction opening method is used. As can be seen from the figures, the lift tab area has been reduced from full-length to a small lift tab 52. This small lift tab opening allows for a cut score ply separation also in a left-to-right direction and greatly reduces the resistance to opening. This being set forth in detail in the above-mentioned copending application.

Figure 2:
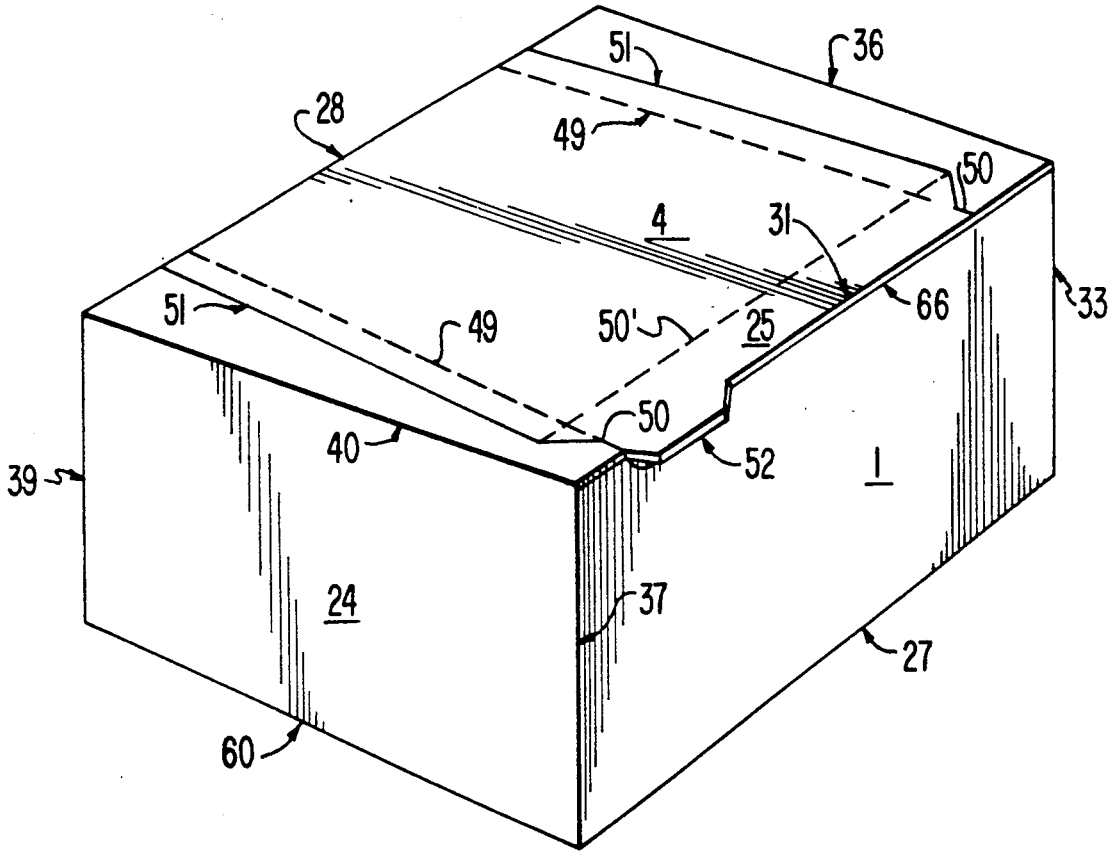
FIG. 2 is a perspective view of an erected carton in accordance with the present invention.
Figure 3:
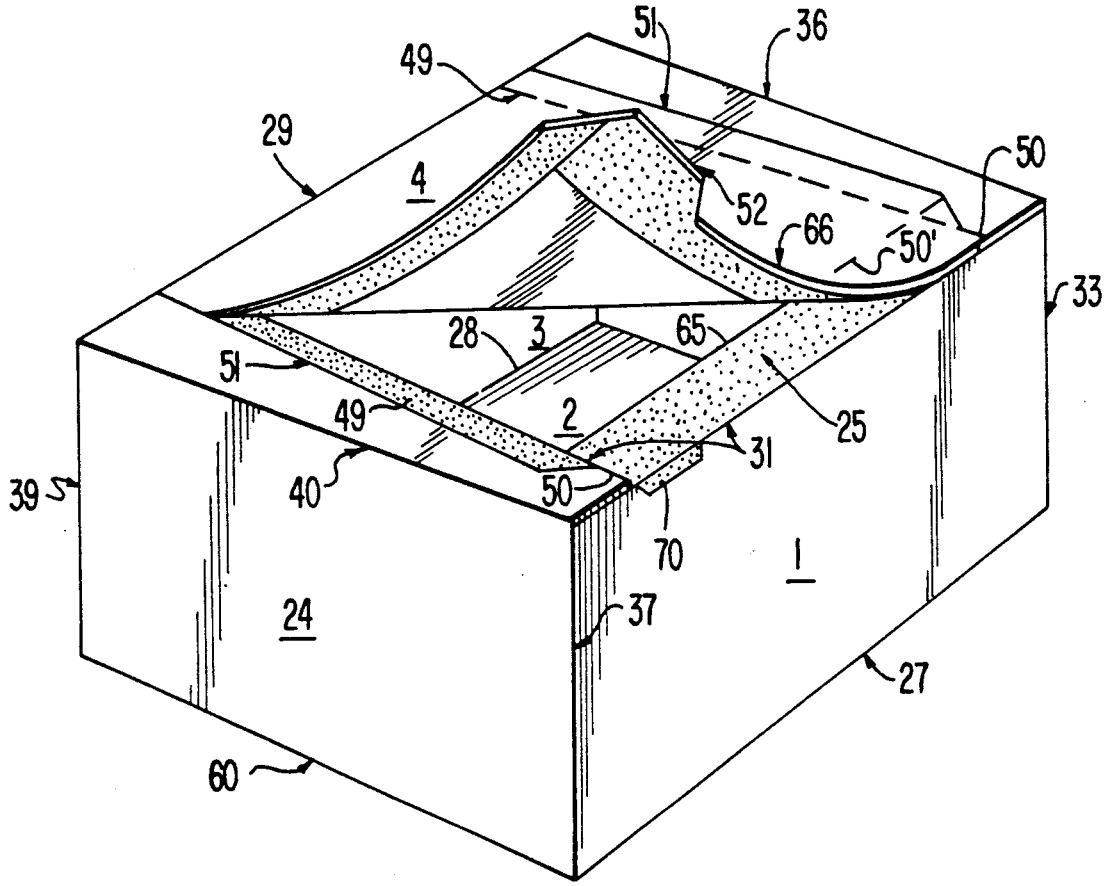
FIG. 3 is a perspective view of the carton in a partially opened condition.
Figure 4:
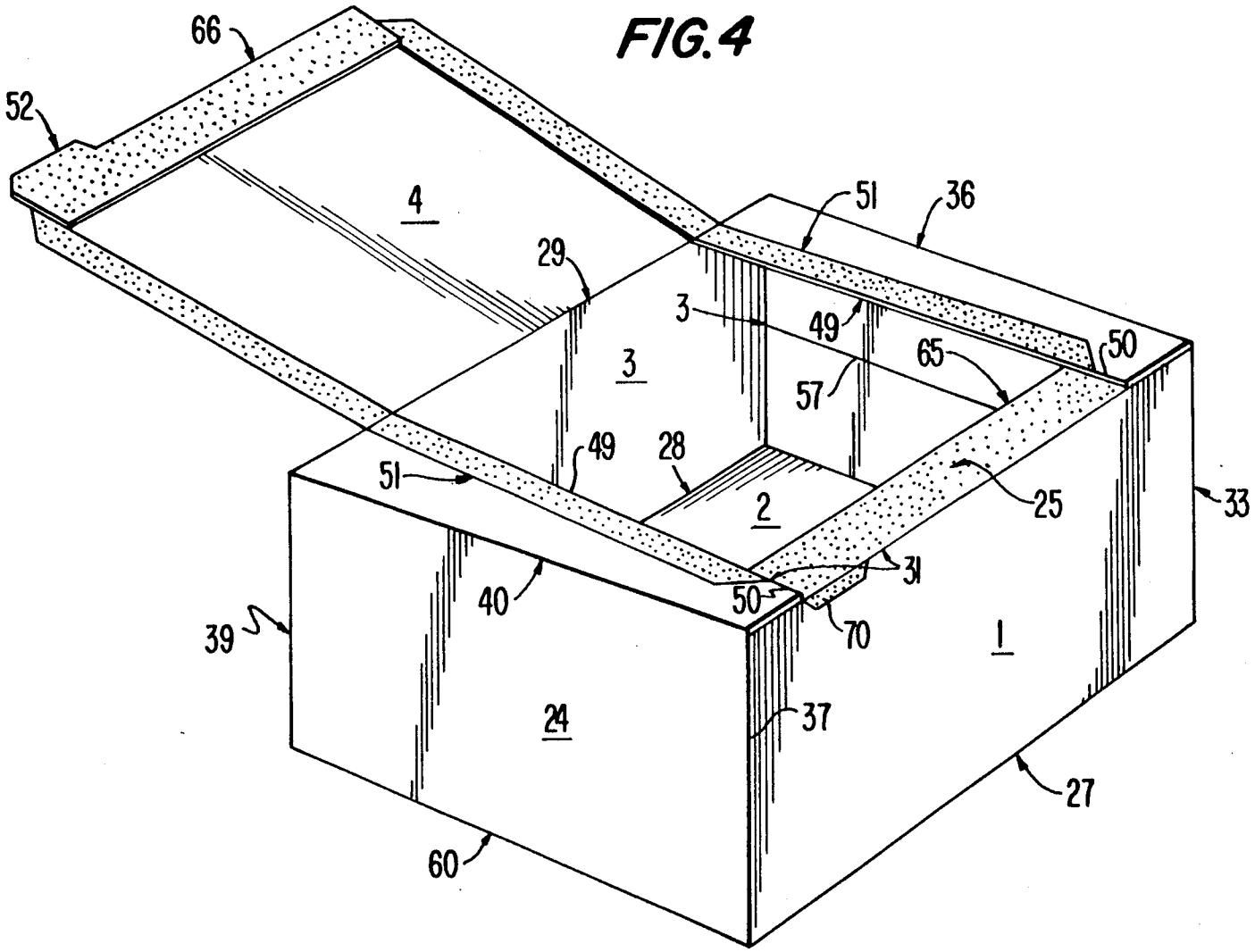
FIG. 4 is a perspective view of the carton in a fully opened condition.

Another significance of the left-to-right opening is that if a front-to-rear opening direction were used, score line 65 of the skived area 26 would have to be perforated to provide a break away of the skived and hemmed area at the time the ply separation of cut scored area 25 reaches line 65. The perforation with its alternate knife cuts, however, would provide entry of moisture vapor or other gases into the carton detrimentally affecting the performance of the carton. For that reason line 65 is an uncut fold line of which the fold is controlled by the skived offset at that point. Additionally, the left-to-right opening direction will cause the remaining thickness of 0.005 that has been hemmed onto the outside of the side seam 25 and over a release area 66 to tear easily along line 65 as shown in FIG. 3. A front-to-rear action of the crease score line 49 and cut score line 51 will take place and when the ply separation of cut scored area 25 reaches the second crease score 49 and cut score 51, the same front-to-rear opening action will take place. These sequential opening steps being illustrated in FIGS. 2–4. The carton is now fully opened as shown in FIG. 4 for either product consumption or removal of the item packaged. Additionally provided in the front panel 1 is a release area 70 which is formed by a partial cut score line 72 corresponding to the lift tab 52 such that when the carton is erected, the lift tab is permitted to extend from the top panel 4 as illustrated in FIG. 2. The significance of this release area is set forth in greater detail in the above-mentioned copending application.

Figure 7:
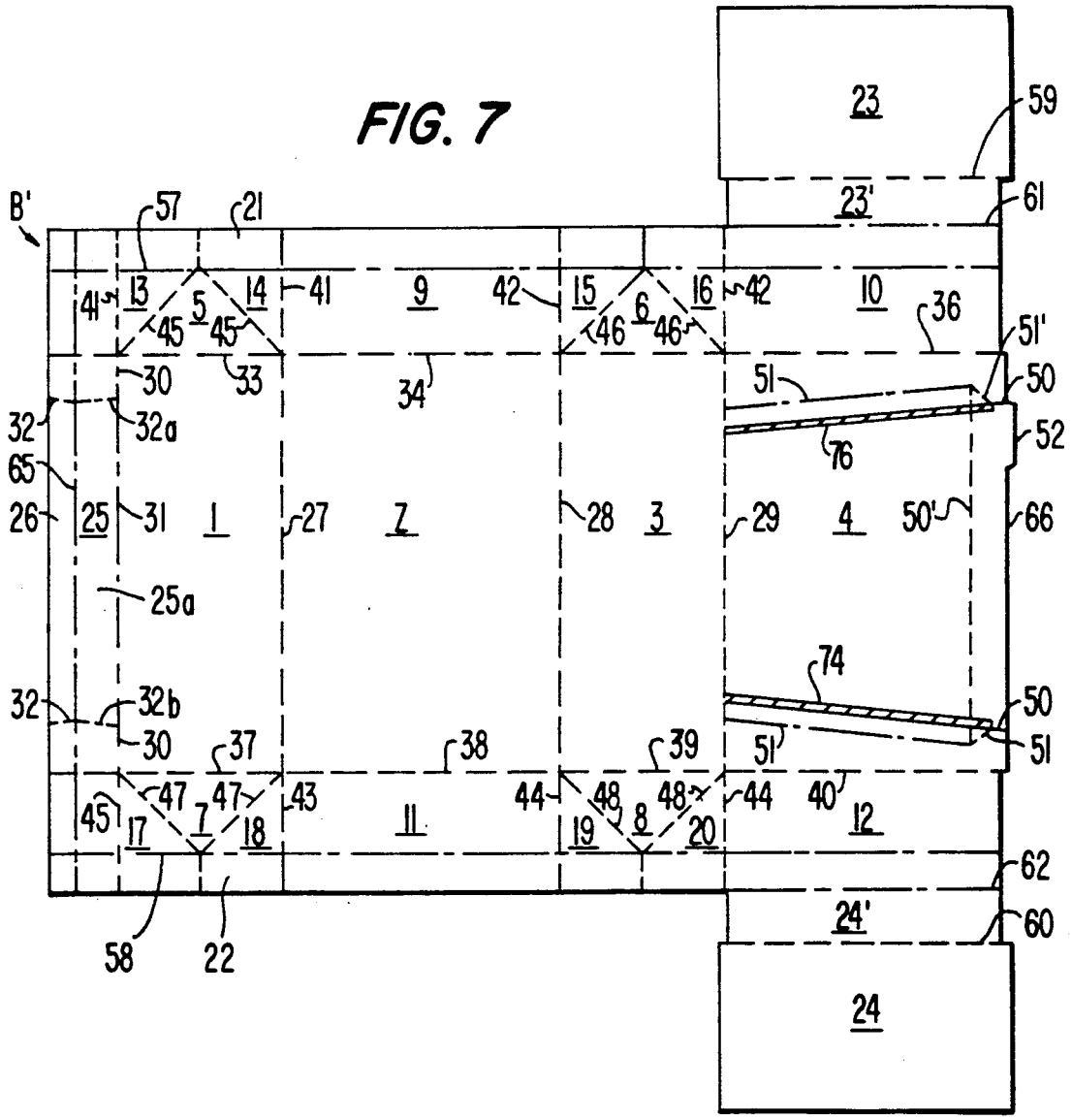
FIG. 7 is a plan view of the carton blank in accordance with an alternative embodiment of the present invention.

Referring now to FIG. 7, the blank B′ is illustrated and is essentially identical to that of blank B set forth in FIG. 1 with the exception of the particular opening feature formed in the top panel 4. Therefore, like structures are referenced by like numerals to that of FIG. 1. When forming a carton of the blank illustrated in FIG. 1, it is necessary to overcoat the inside partially cut score line of weakness in order to maintain the high barrier nature of the formed carton. However, because the partially cut score line is a thin single cut line, often the overcoat material, generally a polymer material, may not sufficiently fill the entire partially cut score line, thus resulting in an ineffective barrier between the contents and the environment. In order to overcome the foregoing, knurled lines of weakness 74 and 76 may be provided.

The knurled lines of weakness are formed by pressing a metal plate having a raised surface or surfaces in the form of a knurl pattern on the top area of the raised surface. In contrast to the aforementioned thin, partially cut score lines of weakness, the knurled lines of weakness 74 and 76 are relatively wide and, consequently, when overcoated, the reservoir formed by the wide knurled line will readily receive the overcoat material therein. The knurled lines of weakness 74 and 76 are formed in accordance with a preferred embodiment of the invention by first forming a coarse diamond pattern on a knurling plate by a coarse diamond knurling tool and, subsequently, forming a similar but medium diamond pattern on the same knurling plate by a medium diamond knurling tool. In doing so, the fibers of the paperboard material are sufficiently broken down by the combination of the coarse diamond knurl pattern and the medium diamond knurl pattern such that when an opening force is applied to the lift tab 52 the paperboard material will readily separate and begin a ply separation in the area between the knurled lines of weakness 74 and 76 and the partially cut lines of weakness 51.

While FIG. 7 illustrates the knurled lines of weakness formed only on the inside of the paperboard blank, the outer lines of weakness shown in FIG. 7 as partially cut lines of weakness 51 may be formed in a similar manner to that of knurled lines of weakness 74 and 76. Accordingly, the opening feature of the carton may include regions of weakness wherein either one of or both the inner and outer lines of weakness are knurled lines of weakness formed in accordance with the foregoing procedure.

Additionally, as can be seen from FIG. 7, the cover flaps 23 and 24 and the intermediate sections 23′ and 24′ have been moved to extend from the end panels 10 and 12 rather than 9 and 11 as illustrated in FIG. 1. In doing so, the upper edge of the resultant container as illustrated in FIG. 2 will include the fold line 60 rather than a bear die cut edge of the cover flap 24. With the folding of the paperboard blank illustrated in FIG. 1, the cover flap 24 is folded upwardly over the end panels 7, 8 and 12 as illustrated in FIG. 6 and, consequently, results in a die cut edge being present along the periphery of the top panel 4. By constructing the blank B′ as illustrated in FIG. 7, the cover flap 24 will be folded downwardly over the end panel 7, 8 and 12 and, consequently, a fold line 60 will be present about the periphery of the top panel 4. The remaining portion of the carton blank B′ is identical to that of the carton blank B illustrated in FIG. 1 and the sequence of folding the end panels is carried out in the manner as discussed with reference to FIGS. 5 and 6.

As can be seen from the foregoing, a carton formed in accordance with the present invention will provide a barrier between the contents of the carton and the environment, thus removing the possibility of contamination of the contents within the carton or any leakage of the contents of the carton. Moreover, by forming the carton in accordance with the present invention, a reliable opening feature is provided which is capable of being opened by the consumer with ease and which will resist the infiltration of moisture while not retarding the structural integrity of the carton when opened.

While the present invention has been described with reference to the preferred embodiment, it will be appreciated by those skilled in the art that the invention may be practiced otherwise then as specifically described herein without departing from the spirit and scope of the invention. It is, therefore, to be understood that the spirit and scope of the invention be limited only by the appended claims.

What is claimed is:

1. A carton blank formed of a paperboard material for forming a paperboard carton, said blank comprising:

a first panel having side walls connected thereto by scored fold lines formed between a respective one of said side walls and a respective edge of said first panel;

a second panel having a side wall connected thereto by a scored fold line formed between said side wall and an edge of said second panel, one of said side walls of said first panel and said side wall of said second panel being congruent;

a seal flap extending a predetermined distance from a predetermined edge of one of said side walls of said first panel, said predetermined edge of said side wall being that edge which extends adjacent to a predetermined edge of said second panel of a carton formed from the blank;

opposing end panels connected to each of said side walls and said first and second panels, each of said end panels having at least one die cut edge;

an opening means defined by said predetermined edge of said second panel and regions of weakness formed in said second panel and extending from said predetermined edge of said second panel for permitting access to the inside of a carton formed from the blank;

a predetermined skived region extending along each of said end panels adjacent said die cut edge; and cover means extending from one of opposing end panels for covering the end panels of the carton formed from the blank;

wherein there are no die cut edges exposed within the carton formed from the blank.

2. The blank as defined in claim 1, wherein each of said regions of weakness includes an inner line of weakness and an outer line of weakness, with said inner and outer lines of weakness extending substantially parallel to one another.

3. The blank as defined in claim 2, wherein at least one of said inner and outer lines of weakness is a knurled line of weakness.

4. The blank as defined in claim 3, wherein a width of the predetermined skived region of the end panels is not greater than a remaining width of the end panels.

5. The blank as defined in claim 4, wherein said seal flap includes opposing end panels extending therefrom, said end panels of said seal flap including said skived region.

6. The blank as defined in claim 5, wherein adjacent end panels of each of said side walls, said first panel and said second panel are connected to one another by crease score fold lines, said fold lines being coextensive with said fold lines between adjacent side walls, said first panel and said second panel.

7. The blank as defined in claim 6, further comprising angular crease score fold lines extending from a respective intersection of respective fold lines between said first and second panels and said side walls, and said respective fold lines between said side walls, said first panel and said second panel and said end panels towards a mid-point of the end panels of respective side walls adjacent said skived region.

8. The blank as defined in claim 6, further including lead-in through cut lines extending from said predetermined edge of said second panel to a point of intersection of said respective inner and outer partially cut score lines.

9. The blank as defined in claim 8, wherein said seal flap includes a release area underlying said opening means for permitting said opening means to be released from said seal flap.

10. The blank as defined in claim 9, wherein said release area is defined by a partially cut score line extending substantially coextensive with said predetermined edge of said side wall and partially cut score lines which substantially underlie said lead-in through cuts formed in said second panel of the formed carton so that a ply separation occurs in said release area in response to an opening force being applied to said opening means of the formed carton.

11. The blank as defined in claim 10, further comprising an extension panel extending from an edge of said seal flap substantially parallel to said predetermined edge of said first panel, said extension panel being skived and overfolded onto said seal flap.

12. A carton for containing a product placed therein, said carton comprising:

a bottom panel;

a top panel;

side walls extending from said bottom panel to said top panel;

overlapping end walls extending from said bottom panel to said top panel;

a seal flap extending a predetermined distance from a predetermined edge of one of said side walls, said predetermined edge of said side wall being that edge which extends adjacent to a predetermined edge of said top panel;

an opening means defined by said predetermined edge of said top panel and regions of weakness formed in said top panel and extending from said predetermined edge of said top panel for permitting access to the interior of the carton; and cover means for covering said end walls on opposing ends of the carton;

wherein a predetermined region of each of said end wall adjacent a die cut edge thereof is skived such that the overlapping portions of said end walls is reduced.

13. The carton as defined in claim 12, further comprising an opening force receiving means defined by said regions of weakness and said predetermined edge of said top panel.

14. The blank as defined in claim 13, wherein each of said regions of weakness includes an inner line of weakness and an outer line of weakness, with said inner and outer lines of weakness extending substantially parallel to one another.

15. The carton as defined in claim 14, wherein respective inner and outer lines of weakness converge towards one another in a region adjacent said predetermined edge of said top panel.

16. The carton as defined in claim 15, further comprising lead-in through cut lines extending from said predetermined edge of said top panel to a point of intersection of said respective inner and outer lines of weakness.

17. The carton as defined in claim 14, wherein at least one of said inner and outer lines of weakness is a knurled line of weakness.

18. The carton as defined in claim 16, wherein said seal flap includes a release area underlying and sealed to said opening force receiving means for permitting said opening force receiving means to be released from said seal flap.

19. The carton as defined in claim 18, wherein said release area is defined by a partially cut score line extending substantially coextensive with said predetermined edge of said side wall and partially cut score lines which substantially underlie said lead-in through cuts formed in said second panel of the formed carton so that a ply separation occurs in said release area in response to an opening force being applied to said opening force receiving means of the carton.

20. The carton as defined in claim 19, further comprising an extension panel extending from an edge of said seal flap substantially parallel to said predetermined edge of said top panel, said extension panel being skived and overfolded onto said seal flap.

* * * * *